US007303260B2

(12) United States Patent
Osada et al.

(10) Patent No.: US 7,303,260 B2
(45) Date of Patent: Dec. 4, 2007

(54) LIQUID EJECTION RECORDING HEAD

(75) Inventors: Torachika Osada, Yamato (JP); Akihiro Yamanaka, Yokohama (JP); Tomoyuki Inoue, Yokohama (JP); Michinari Mazutani, Kawasaki (JP); Hiroshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 334 days.

(21) Appl. No.: 11/218,856

(22) Filed: Sep. 2, 2005

(65) Prior Publication Data

US 2006/0050110 A1 Mar. 9, 2006

(30) Foreign Application Priority Data

Sep. 7, 2004 (JP) ..... 2004-259630

(51) Int. Cl.
*B41J 2/14* (2006.01)

(52) U.S. Cl. ..... 347/47

(58) Field of Classification Search ..... 347/40, 347/47

See application file for complete search history.

(56) References Cited

U.S. PATENT DOCUMENTS 6,137,502 A 10/2000 Anderson
6,309,051 B1 10/2001 Koitabashi
6,789,877 B2 * 9/2004 Murakami et al. ..... 347/40
7,025,438 B2 * 4/2006 Murakami et al. ..... 347/43

FOREIGN PATENT DOCUMENTS

JP 8-183179 7/1996

* cited by examiner

*Primary Examiner*—An H. Do
(74) *Attorney, Agent, or Firm*—Canon U.S.A. Inc. IP Div

(57) ABSTRACT

A compact liquid ejection recording head capable of forming high-quality images at high speed includes large nozzles for ejecting large droplets, medium nozzles for ejecting medium droplets, and small nozzles for ejecting small droplets. The large nozzles are arranged on one side of an ink supply port, while the small nozzles and the medium nozzles are arranged on the other side of the ink supply port. The number of the small nozzles is larger than that of the medium nozzles, and that of the large nozzles. This allows high-quality and high-speed printing using the small nozzles, high-speed photo printing using the medium and small nozzles, and high-speed printing using the large nozzles.

7 Claims, 9 Drawing Sheets

LIQUID EJECTION RECORDING HEAD

This application is related to co-pending application Ser. No. 11/219,116 filed on Sep. 2, 2005.

BACKGROUND OF THE INVENTION

1. Field of the Invention

The present invention relates to liquid ejection recording heads for ejecting liquid to a recording medium, and specifically to a liquid ejection recording head for ejecting a plurality of droplets of multiple volumes to a recording medium.

2. Description of the Related Art

The resolution offered by color inkjet printers using thermal inkjet technology is increasing rapidly. In particular, in recording heads for forming images, the resolution of nozzles from which droplets are ejected is increasing yearly, such as from 600 dpi to 1200 dpi.

As for the size of ink droplets for forming images, in particular, color ink droplets ejected from a recording head, the size is decreasing yearly from, for example, about 15 pl to 5 pl, then to 2 pl for reducing graininess in halftones in gray-scale images, and halftones and highlights in color photo images.

However, for printing rough images not requiring high resolution, such as color graphs in reports, recording heads for producing small droplets and printing high-resolution images cannot meet demands for high-speed printing, because of the large amounts of output data and time required for data transfer.

To accommodate high-speed printing, it is desirable that recording heads be capable of forming images with relatively large droplets and small amounts of data. For high-quality printing, on the other hand, it is desired that the size of droplets be adjusted to minimize the graininess of images. That is, it is required that a group of recording head nozzles for the same color can eject ink droplets of different sizes.

In response, Japanese Patent Laid-Open No. 08-183179 (corresponding to U.S. Pat. No. 6,309,051) discloses means for ejecting ink droplets of different sizes from the same nozzles. In this case, ink channels communicating with the same nozzles are provided with electrothermal transducers of different sizes. Bubbles created by these electrothermal transducers cause ink droplets of multiple sizes to be ejected from the same nozzles.

The specification of U.S. Pat. No. 6,137,502 discloses an inkjet print head having large and small nozzles arranged in a staggered manner, and through which large and small droplets are ejected.

However, in Japanese Patent Laid-Open No. 08-183179, since droplets of different sizes are ejected from the same ink channels, the speed of supplying ink from the rear of the nozzle varies depending on the size of the droplets. In this case, it is difficult for a serial-type recording apparatus to eject droplets of different sizes through one scan of the recording head. It is thus required to eject droplets of different sizes (such as large, medium, and small) through multiple scans of the recording head. That is, since droplets of different sizes cannot be ejected at the same frequency, it is difficult to adjust the size of droplets to accommodate the formation of high-resolution images.

As for the specification of U.S. Pat. No. 6,137,502, the inkjet print head is provided with the same number of large and small nozzles. If the amount of ink to be ejected is set to be large, image quality is degraded in high-quality gray-scale printing (photo printing) while there is no particular problem in high-speed printing, where a large amount of ink is ejected. On the other hand, if the amount of ink to be ejected is set to be small, an increase in the number of print passes causes speed degradation while photo image quality is improved.

SUMMARY OF THE INVENTION

The present invention is directed to a liquid ejection recording head that can accommodate high-speed and high-quality image formation.

In one aspect of the present invention, a liquid ejection recording head includes a plurality of nozzles through which liquid supplied from a liquid supply port is ejected to a recording medium. The plurality of nozzles are provided on both sides of the liquid supply port. The plurality of nozzles includes first nozzles each having a first diameter, second nozzles each having a second diameter, and third nozzles each having a third diameter. The first diameter is larger than the second diameter, and the third diameter is smaller than the second diameter. A number of the third nozzles is greater than a number of the first nozzles, and is greater than a number of the second nozzles.

With the structure described above, it is possible to provide an inkjet recording head that can accommodate high-speed printing (one pass) using large dots, high-speed photo printing (two passes) using medium and small dots, and high-quality and high-speed photo printing using small dots only.

The present invention allows both high-speed printing and high-quality photo printing in any embodiment. Moreover, since large, medium, and small nozzles for ejecting large, medium, and small droplets, respectively, are arranged on both sides of an ink supply port, printing in various print modes can be achieved with a compact recording head, and thus at low cost.

Further features of the present invention will become apparent from the following description of exemplary embodiments with reference to the attached drawings.

DESCRIPTION OF THE EMBODIMENTS

Embodiments of the present invention will now be described with reference to the drawings.

Figure 9:
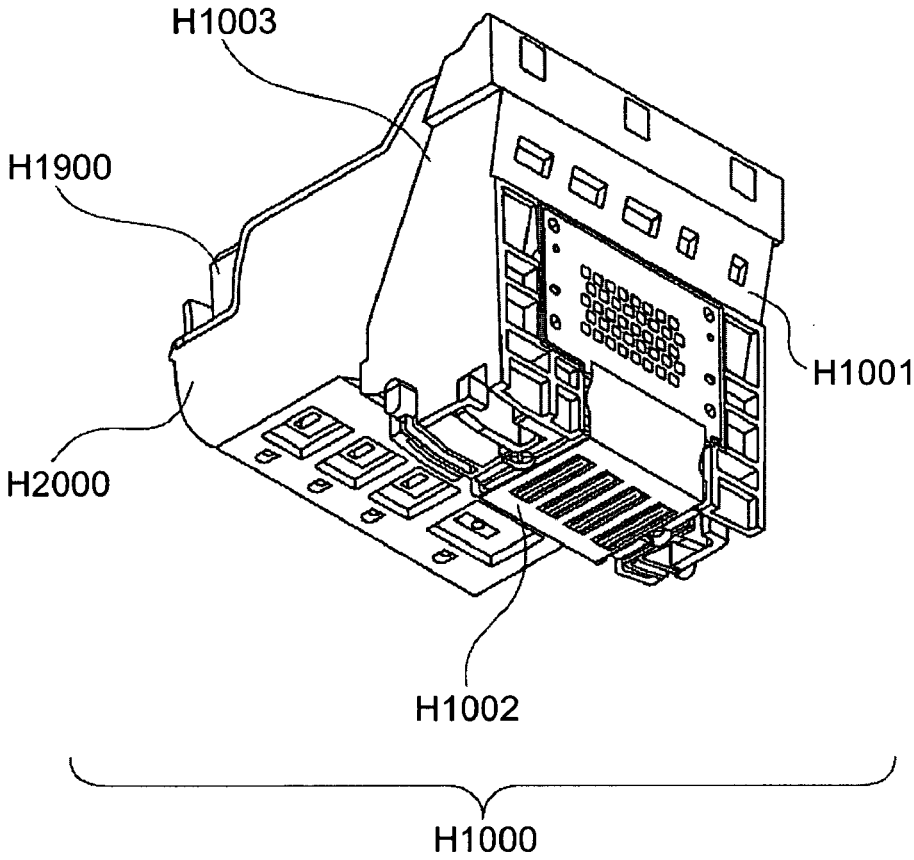
FIG. 9 is a perspective view showing a recording cartridge to which the present invention is applicable.
Figure 10:
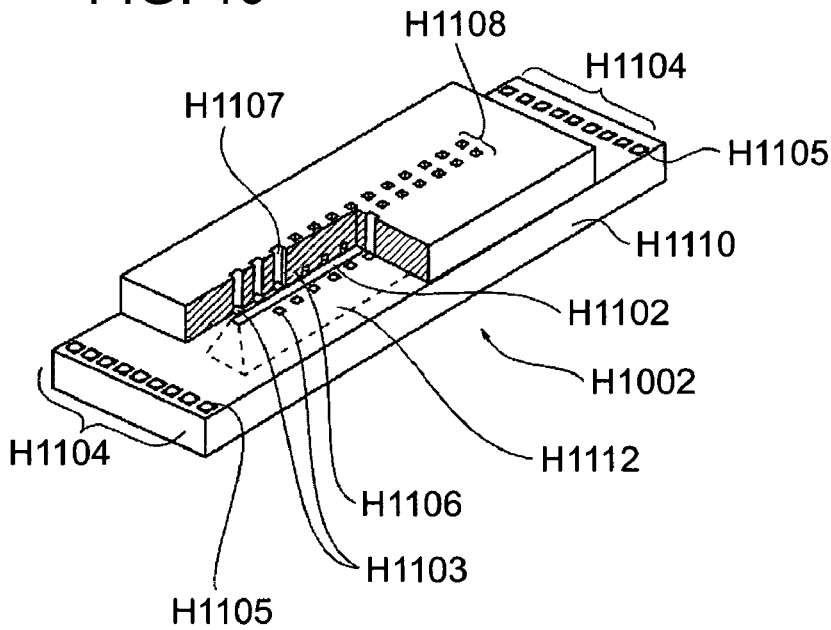
FIG. 10 is a partially notched perspective view showing the structure of a recording element substrate to which the present invention is applicable.

FIG. 9 and FIG. 10 are perspective views for explaining a recording head cartridge, a liquid ejection recording head, and a liquid container to which the present invention is applicable.

The liquid ejection recording head (hereinafter simply referred to as a recording head) of the embodiments is a component of a recording head cartridge. Referring to FIG. 9, a recording head cartridge H1000 includes a recording head H1001 and a liquid container (hereinafter called an ink tank) H1900 removably attached to the recording head H1001 for supplying ink thereto. Based on information to be recorded, the recording head H1001 causes liquid (such as ink) supplied from the ink tank H1900 to be ejected from nozzles, thereby recording text and images on recording media.

The recording head cartridge H1000 is removable from a carriage of the recording apparatus. The recording head cartridge H1000 is electrically connected to the carriage via a connection terminal on the carriage, and secured by a positioning device on the carriage to a predetermined position.

The recording head H1001 performs recording by using a heating element as an electrothermal transducer that produces, in response to electric signals, heat energy causing film boiling in ink to occur. As shown in FIG. 9, the recording head H1001 includes a recording element unit H1002, an ink supply unit H1003, the ink tank H1900, and a tank holder H2000. The recording element unit H1002 is for recording text and images on a recording medium, such as recording paper. The ink supply unit H1003 is for supplying ink in the ink tank H1900 to the recording element unit H1002. The tank holder H2000 removably holds the ink tank H1900.

The recording element unit H1002 of the embodiments includes four recording elements for ejecting black, cyan, magenta, and yellow ink from ink tanks for the respective colors.

FIG. 10 is a partially notched perspective view showing one of the recording elements for explaining the structure of the recording element unit H1002. The recording element is disposed on a surface of a silicon (Si) substrate H1110 having a thickness of about 0.5 mm to 1.0 mm. A plurality of electrothermal transducers H1103 for ejecting ink and electric wires made of aluminum (Al) or the like for supplying power to each electrothermal transducer H1103 are deposited on the recording element. A plurality of ink channels and nozzles H1107 corresponding to the electrothermal transducers H1103 are formed by photolithography on the recording element. Each ink channel communicates with a common reservoir H1112 having an ink supply port H1102 from which ink is supplied.

The common reservoir H1112 having the ink supply port H1102 is formed by, for example, anisotropic etching using the crystal orientation of Si, or sandblasting.

The recording element is provided with a line of electrothermal transducers H1103 arranged on each of both sides of the ink supply port H1102 in a staggered manner. The electrothermal transducers H1103 and the electric wires of Al or the like for supplying power to the electrothermal transducers H1103 are deposited on the recording element. Moreover, electrodes H1104 for supplying power to the electric wires are provided on both sides of the electrothermal transducers H1103. The electrodes H1104 are provided with bumps H1105 of gold (Au) or the like formed by ultrasonic thermocompression bonding. Ink channel walls H1106 defining the ink channels corresponding to the respective electrothermal transducers H1103, and the nozzles H1107 are on the Si substrate H1110. The ink channel walls H1106 and the nozzles H1107 made of resin and formed by photolithography constitute a nozzle group H1108. Since the nozzles H1107 are provided at positions corresponding to the respective electrothermal transducers H1103, bubbles generated by heat generation of the electrothermal transducers H1103 cause ink supplied through the ink supply port H1102 to the ink channels to be ejected from the nozzles H1107.

Each embodiment of the present invention will be described below. Diagrams for explaining a nozzle configuration illustrate the configuration for one recording element only. The same nozzle configuration may be applied to all recording elements, or may be applied only to some recording elements for ejecting ink of specific colors (for example, black only or all colors except black).

First Embodiment

Figure 1:
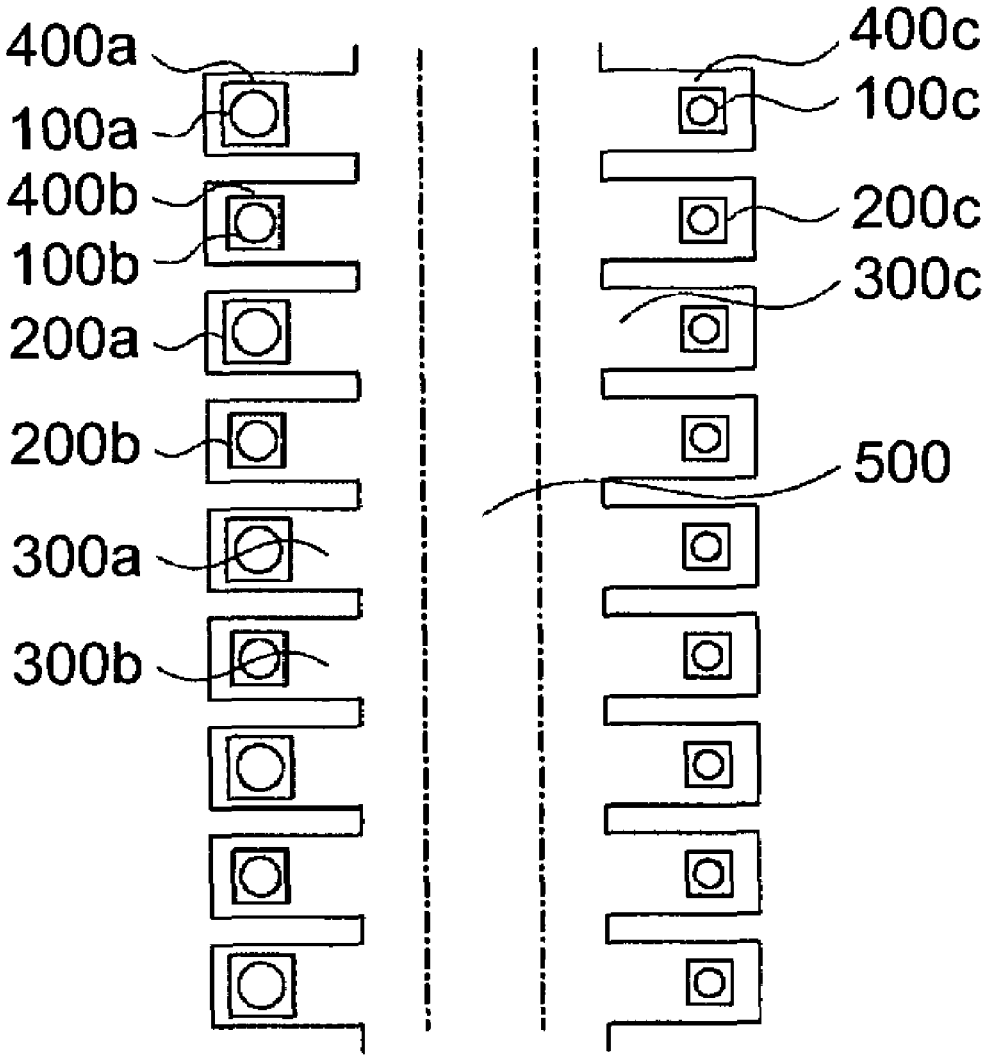
FIG. 1 is a diagram for explaining a nozzle configuration according to a first embodiment of the present invention.

FIG. 1 is a diagram for explaining a nozzle configuration according to the first embodiment of the present invention.

A recording element of the present embodiment is provided with first nozzles 100*a* each having a first diameter, second nozzles 100*b* each having a second diameter smaller than the first diameter, and third nozzles each having a third diameter smaller than the second diameter. Droplets ejected from the first nozzles have the largest diameter, and droplets ejected from the third nozzles have the smallest diameter. Therefore, the first nozzles, the second nozzles, and the third nozzles will hereinafter be referred to as "large nozzles", "medium nozzles", and "small nozzles", respectively, and droplets ejected therefrom will be referred to as "large dots", "medium dots", and "small dots", respectively.

In the present embodiment, a plurality of large nozzles 100*a* and medium nozzles 100*b* are alternately arranged on the left side of an ink supply port 500, while a plurality of small nozzles 100*c* are arranged on the right side of the ink supply port 500. The large nozzles 100*a*, the medium nozzles 100*b*, and the small nozzles 100*c* communicate with the ink supply port 500 via pressure chambers 400*a*, pressure chambers 400*b*, and pressure chambers 400*c*, and via ink channels 300*a*, ink channels 300*b*, and ink channels 300*c*, respectively.

In FIG. 1, the volume of droplets Va ejected from each large nozzle 100*a* is 10 pl, the volume of droplets Vb ejected from each medium nozzle 100*b* is 2.5 pl, and the volume of droplets Vc ejected from each small nozzle 100*c* is 1 pl. These volumes can be achieved by adjusting the sizes of the large nozzles 100*a*, medium nozzles 100*b*, and small nozzles 100*c*, and their corresponding thermal transducers 200*a*, thermal transducers 200*b*, and thermal transducers 200*c* to optimum levels. In the present embodiment, the large nozzles 100*a*, the medium nozzles 100*b*, and the small nozzles 100*c* have nozzle exit areas of about 300 $\mu m^2$, 110 $\mu m^2$, and 70 $\mu m^2$, respectively. Their corresponding thermal transducers 200*a*, 200*b*, and 200*c* have sizes of about 30 μm×30 μm, 22 μm×22 μm, and 20 μm×20 μm, respectively. The nozzles 100*a*, 100*b*, and 100*c* are arranged at a pitch of about 42.3 μm.

For example, in the case where a 600 dpi pixel is to be printed through four scans of a head with the above-described nozzles, the volume of ejected droplets can be changed within the range of 1 pl to 29 pl. For printing through one scan, droplets are ejected from all the nozzles 100*a*, 100*b*, and 100*c*, and the volume of droplets per 300 dpi pixel is 29 pl. For high-speed 300 dpi printing, where high image quality is not particularly needed, the volume of droplets as small as that described above does not cause a significant problem. However, for better image quality, scanning may be performed twice to increase the volume of droplets up to 58 pl. These are not limited to specific values, and may be determined depending on the balance between image quality and speed.

Thus, gray-scale printing required for printing, through multiple scans, high-quality images (such as photo images), and high-speed printing for normal color images (such as color graphs) are both achieved. Moreover, higher-density and higher-quality printing where only the small nozzles 100*c* for 1 pl droplets are used can be achieved without substantial degradation in print speed.

While the nozzles for ejecting 1 pl, 2.5 pl, and 10 pl droplets are provided on the same recording element substrate in the present embodiment, the volume of droplets is not limited to this example.

Modifications of the present embodiment will now be described with reference to FIGS. 2A to 2C.

Figure 2C:
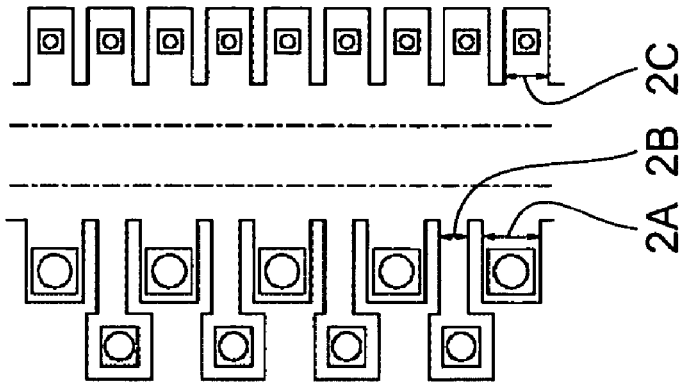
FIGS. 2A to 2C are diagrams for explaining modifications of the first embodiment.
Figure 2B:
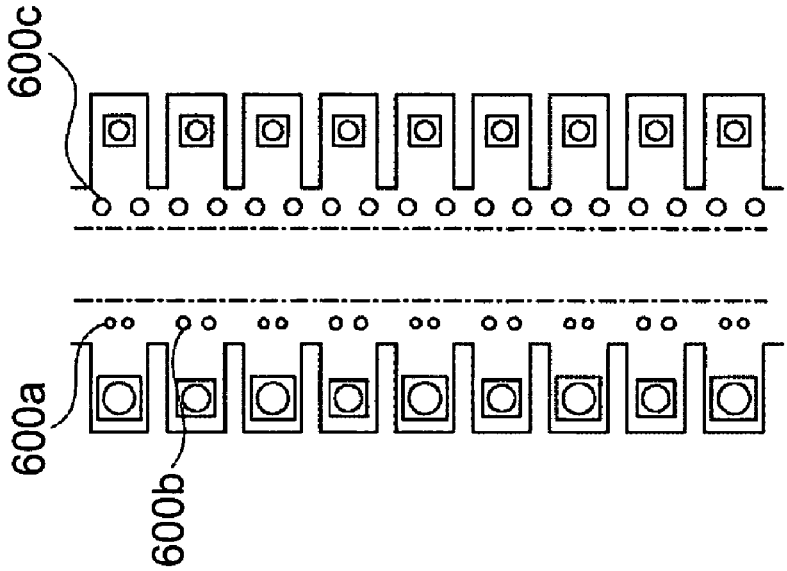
Figure 2A:
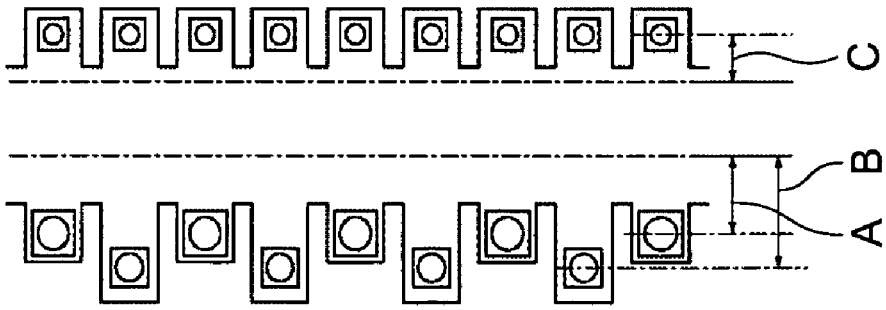

FIGS. 2A to 2C are diagrams for explaining modifications according to the first embodiment of the present invention.

FIG. 2A is the same as FIG. 1 except for the lengths of ink channels on the recording element substrate. As shown in FIG. 2A, the lengths of the ink channel 300*a*, ink channel 300*b*, and ink channel 300*c* vary according to the lengths of the large nozzle 100*a*, medium nozzle 100*b*, and small nozzle 100*c*, respectively. Specifically, as shown in FIG. 2A, the relationship between the lengths A, B, and C of the ink channels 300*a*, 300*b*, and 300*c*, respectively, is B>A>C. Based on this relationship, refill time for 10 pl droplets ejected from the large nozzle 100*a*, refill time for 2.5 pl droplets ejected from the medium nozzle 100*b*, and refill time for 1 pl droplets ejected from the small nozzle 100*c* can be adjusted to accommodate gray-scale printing at the same drive frequency. Moreover, a drive frequency can be increased to accommodate high-resolution and high-quality printing where only 1 pl droplets from the small nozzle 100*c* are used.

FIG. 2B is the same as FIG. 1 except that nozzle filters are provided on the recording element substrate. Referring to FIG. 2B, the shapes of nozzle filters 600*a*, nozzle filters 600*b*, and nozzle filters 600*c* corresponding to the large nozzles 100*a*, medium nozzles 100*b*, and small nozzles 100*c*, respectively, vary accordingly. As shown in FIG. 2B, the nozzle filters are arranged at the rear end of the ink channel wall, and vary in shape depending on the sizes of the large, medium, and small nozzles. This reduces print quality problems caused by dirt in small nozzles. At the same time, refill time for 10 pl droplets ejected from a large nozzle, refill time for 2.5 pl droplets ejected from a medium nozzle, and refill time for 1 pl droplets ejected from a small nozzle can be adjusted to accommodate gray-scale printing at the same drive frequency. Although the nozzle filters in this modification are circular cylindrical in shape, they may be made in other shapes.

FIG. 2C is the same as FIG. 1 except the shapes of ink channels on the recording element substrate. As shown in FIG. 2C, the shapes of the ink channel 300*a*, ink channel 300*b*, and ink channel 300*c* vary according to the lengths of the large nozzle 100*a*, medium nozzle 100*b*, and small nozzle 100*c*, respectively. Specifically, as shown in FIG. 2C, the relationship between the widths 2A, 2B, and 2C of the ink channels 300*a*, 300*b*, and 300*c*, respectively, is 2A>2C>2B. Based on this relationship, refill time for 10 pl droplets ejected from the large nozzle 100*a*, refill time for 2.5 pl droplets ejected from the medium nozzle 100*b*, and refill time for 1 pl droplets ejected from the small nozzle 100*c* can be adjusted to accommodate gray-scale printing at the same drive frequency. Moreover, a drive frequency can be increased to accommodate high-resolution and high-quality printing where only 1 pl droplets from the small nozzle 100*c* are used.

Second Embodiment

Figure 3A:
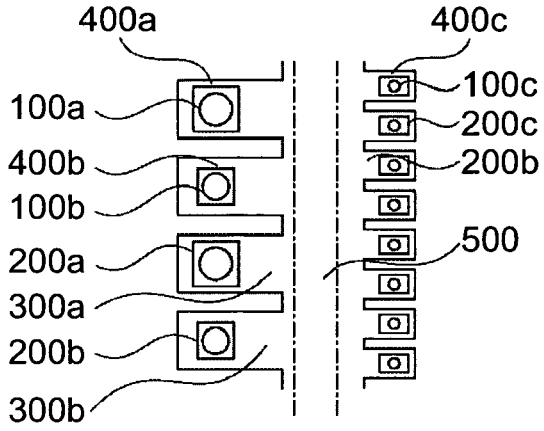
FIGS. 3A and 3B are diagrams for explaining nozzle configurations according to a second embodiment of the present invention.

FIG. 3A is a diagram for explaining a nozzle configuration according to the second embodiment of the present invention.

In the present embodiment, a plurality of large nozzles 100*a* and medium nozzles 100*b* are alternately arranged on the left side of an ink supply port 500, while a plurality of small nozzles 100*c* are arranged on the right side of the ink supply port 500. The large nozzles 100*a*, the medium nozzles 100*b*, and the small nozzles 100*c* communicate with the ink supply port 500 via pressure chambers 400*a*, pressure chambers 400*b*, and pressure chambers 400*c*, and via ink channels 300*a*, ink channels 300*b*, and ink channels 300*c*, respectively.

In the present embodiment, the volume of droplets Va ejected from each large nozzle 100*a* is 10 pl, the volume of droplets Vb ejected from each medium nozzle 100*b* is 2.5 pl, and the volume of droplets Vc ejected from each small nozzle 100*c* is 1 pl. These volumes can be achieved by adjusting the sizes of the large nozzles 100*a*, medium nozzles 100*b*, and small nozzles 100*c*, and their corresponding thermal transducers 200*a*, thermal transducers 200*b*, and thermal transducers 200*c* to optimum levels. Specifically, in the present embodiment, the large nozzles 10*a*, the medium nozzles 100*b*, and the small nozzles 100*c* have nozzle exit areas of about 300 $\mu m^2$, 100 $\mu m^2$, and 70 $\mu m^2$, respectively. Their corresponding thermal transducers 200*a*, 200*b*, and 200*c* have sizes of about 30 μm×30 μm, 22 μm×22 μm, and 16 μm×25 μm, respectively. The large nozzles 10*a* and the medium nozzles 100*b* are arranged at a pitch of about 42.3 μm, while the small nozzles 100*c* are arranged at a pitch of about 21.2 μm.

For example, in the case where a 600 dpi pixel is to be printed through four scans of a head with the above-described nozzles, the volume of ejected droplets can be changed within the range of 1 pl to 33 pl. For printing through one scan, droplets are ejected from all the nozzles 100*a*, 100*b*, and 100*c*, and the volume of droplets per 300 dpi pixel is 33 pl. For high-speed 300 dpi printing, where high image quality is not particularly needed, the volume of droplets as small as that described above does not cause a significant problem. However, for better image quality, scanning may be performed twice to increase the volume of droplets up to 66 pl. These are not limited to specific values, and may be determined depending on the balance between image quality and speed.

Thus, gray-scale printing required for printing, through multiple scans, high-quality images (such as photo images), and high-speed printing for normal color images (such as color graphs) are both achieved. Moreover, higher-density and higher-quality printing where only the small nozzles 100*c* for 1 pl droplets, the nozzles being arranged at a smaller pitch, are used can be achieved without substantial degradation in print speed.

While the nozzles for ejecting 1 pl, 2.5 pl, and 10 pl droplets are provided on the same recording element substrate in the present embodiment, the volume of droplets is not limited to this example. While the small nozzles are arranged at twice the density of the medium and large nozzles, the density is not limited to this example.

Figure 3B:
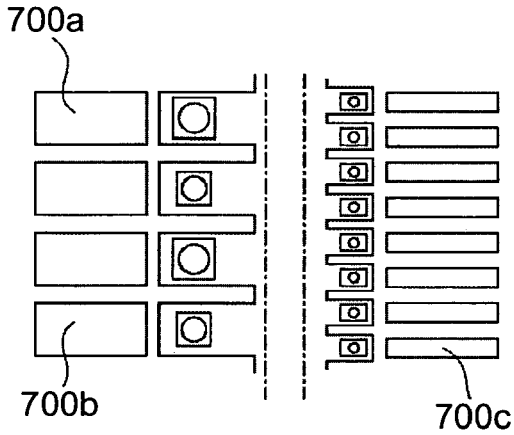

FIG. 3B illustrates the configuration of a metal-oxide semiconductor (MOS) transistor for driving thermoelectric transducers of the present embodiment. As shown in FIG. 3B, the relationship between a MOS transistor 700*a* for driving the thermal transducer 200*a* disposed under the large nozzle 100*a*, a MOS transistor 700*b* for driving the thermal transducer 200*b* disposed under the medium nozzle 100*b*, and a MOS transistor 700*c* for driving the thermal transducer 200*c* disposed under the small nozzle 100*c* can be expressed as A≧B>C, where the areas of the MOS transistors 700*a*, 700*b*, and 700*c* are A, B, and C, respectively. Since only the thermal transducers 200*c* for the small nozzles 100*c* are rectangular in shape, the amount of current flowing through the thermal transducers 200*c* can be reduced, and a voltage drop due to the compactness of the MOS transistors 700*c* can be minimized.

As described above, since the areas of thermal transducers for a small volume of droplets are small in size and rectangular in shape, the areas of MOS transistors for driving the thermal transducers can be reduced. This allows small nozzles to be densely arranged without increasing the size of the recording element substrate. The speed of high-density and high-quality printing using only 1 pl droplets ejected from the small nozzles can thus be increased.

Figure 4A:
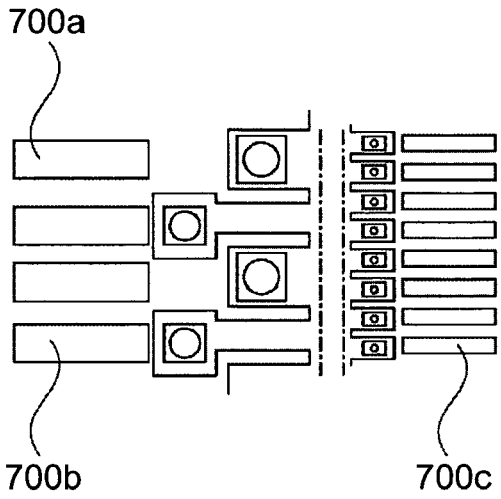
FIGS. 4A and 4B are diagrams for explaining modifications of the second embodiment.
Figure 4B:
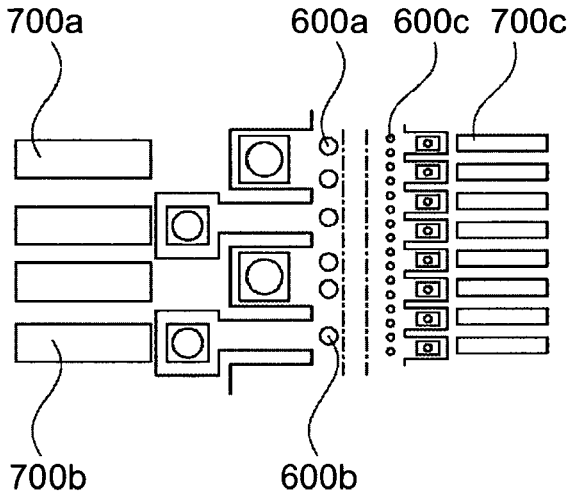

FIGS. 4A and 4B show modifications of the present embodiment. Referring to FIG. 4A, the shapes of the ink channel 300*a*, ink channel 300*b*, and ink channel 300*c* vary according to the lengths of the large nozzle 100*a*, medium nozzle 100*b*, and small nozzle 100*c*, respectively (relationship between the widths of the ink channels is the same as that in FIG. 2C). FIG. 4B differs from the modification in FIG. 4A in that nozzle filters are provided.

Third Embodiment

Figure 5A:
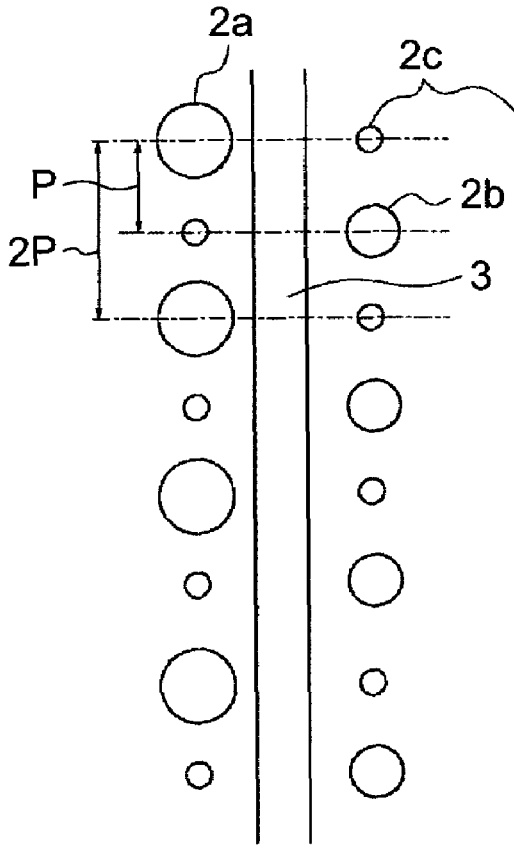
FIGS. 5A and 5B are diagrams for explaining nozzle configurations according to a third embodiment of the present invention.

FIG. 5A shows the third embodiment of the present invention. Referring to FIG. 5A, large nozzles 2*a* (with pitch 2P) for 300 dpi resolution and small nozzles 2*c* (with pitch P) for 600 dpi resolution are arranged on the left side of an ink supply port 3. Center lines of the large nozzles 2*a* on the left side are aligned with corresponding center lines of the small nozzles 2*c* on the right side.

The volume of droplets ejected from each of the large, medium, and small nozzles varies, for example, depending on the nozzle pitch P or the physical properties of the ink. In the present embodiment, where the nozzle pitch P corresponds to a resolution of 600 dpi, the volumes of ink ejected from a large nozzle 2*a*, medium nozzle 2*b*, and small nozzle 2*c* are 12 pl, 4.5 pl, and 1.5 pl, respectively.

By absorption or by the application of pressure, the inkjet recording apparatus causes ink to be supplied from the ink tank (not shown) through an ink supply port 3 to the nozzles of the inkjet recording head.

Figure 6A:
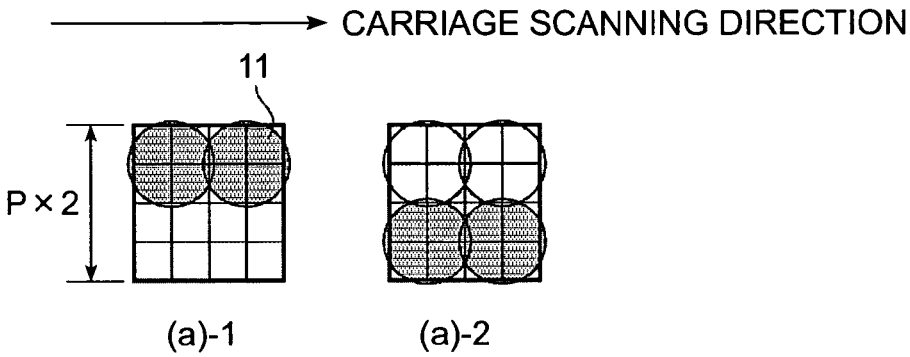
FIGS. 6A to 6C are diagrams for explaining print conditions in each print mode of a liquid ejection recording head according to the third embodiment of the present invention.
Figure 6B:
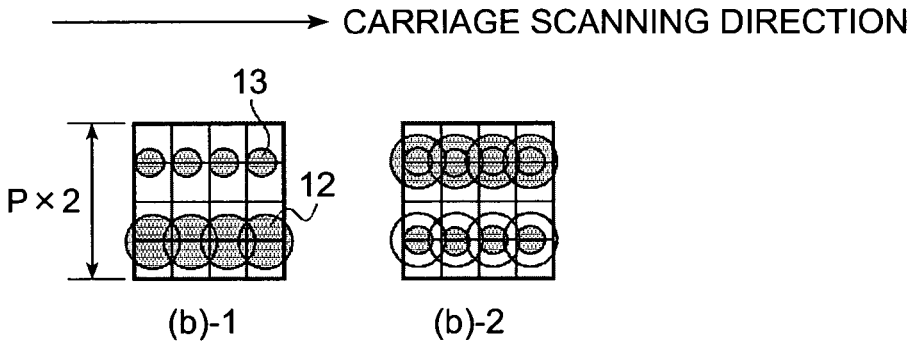
Figure 6C:
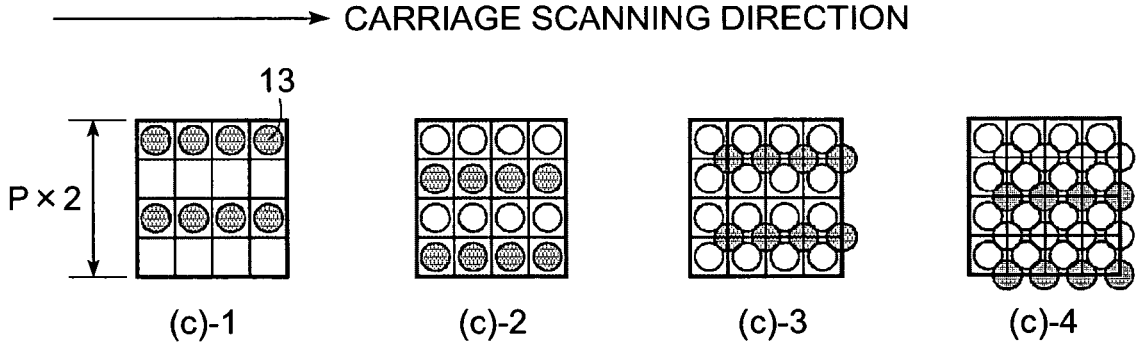

FIGS. 6A to 6C illustrate print conditions in each print mode of a recording head according to the present embodiment. FIG. 6A shows print patterns for high-speed printing, such as color printing on plain paper, FIG. 6B shows print patterns for high-speed photo printing, and FIG. 6C shows print patterns for high-quality photo printing. In FIGS. 6A to 6C, numbers suffixed to (a), (b), and (c) indicate the counts of passes in multipass printing. Shaded circles (print dots) show dots printed in the current pass, and open circles (print dots) show dots printed in previous passes. For clearly presenting the print patterns, FIGS. 6A to 6C only show dots printed in a two-pitch square (300 dpi square) area, and the sizes of the dots are smaller than their actual sizes. The print patterns in each mode will now be described in detail.

In FIG. 6A, (a)-1 shows print patterns for high-speed printing, such as color printing on plain paper, where only large dots 11 from the large nozzles 2*a* are printed. Since the large nozzles 2*a* are arranged at pitch 2P, one dot can be placed within the range of two pitches as shown in (a)-1. The next dot is printed at a point displaced by the distance of pitch P, in the scanning direction, from the current position. Thus, desired printing can be completed (100%) in two passes. Since four large dots 11 are placed in a two-pitch square pixel, the total volume of ejected ink is 4×12 pl=48 pl.

Figure 5B:
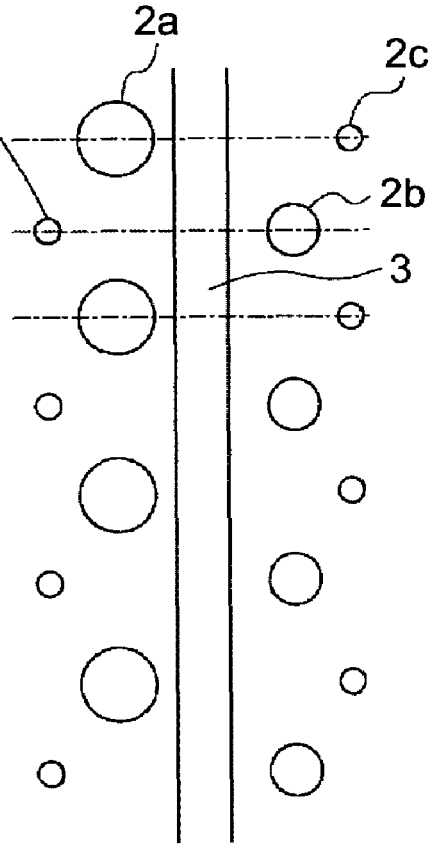

In FIG. 6B, (b)-1 and (b)-2 show print patterns for high-speed photo printing, where medium dots 12 from the medium nozzles 2*b* and small dots 13 from the small nozzles 2*c* are printed. As shown in FIG. 5B, since the medium nozzles 2*b* and the small nozzles 2*c* are alternately arranged at pitch P, a medium dot 12 and a small dot 13 are simultaneously printed within the range of two pitches in the first pass as shown in (b)-1 of FIG. 6B. The next dots are placed at a position displaced by half the distance of pitch P, in the scanning direction, from the current position. Thus, a print resolution of 600 dpi×1200 dpi can be achieved. The ejection frequency of print dots is largely dependent on the size of print dots (volume of ejected ink). The smaller the size of dots, the shorter the time required for ink recovery (hereinafter referred to as refill time), and thus smaller dots allows printing at higher frequencies. Since the large nozzles 2*a* for ejecting the large dots 11 are not used in FIG. 6B, the frequency at which printing is performed is higher than that in the case where the large nozzles 2*a* are used as in FIG. 6A. While the drive frequency in print mode in FIG. 6A is 15 kHz, the drive frequency in current print mode in FIG. 6B is 30 kHz, which is double that in FIG. 6A. Therefore, printing in current print mode can be performed at the same carriage scanning speed as that in FIG. 6A. As shown in (b)-2 of FIG. 6B, after line feed by an odd number times the distance of pitch P, the small dots 13 and the medium dots 12 are placed over the medium dots 12 and the small dots 13, respectively, in the second pass. High-speed photo printing can thus be achieved in the present embodiment, as desired printing can be completed (100%) in two passes without sacrificing the speed of carriage scanning. Since eight medium dots 12 and eight small dots 13 are placed in a two-pitch square pixel, the total volume of ejected ink is 8×(4.5+1.5) pl=48 pl, which is the same as that in printing in FIG. 6A.

FIG. 6C shows print patterns for high-quality photo printing, where only the small dots 13 from the small nozzles 2*c* are printed. As shown in FIG. 5A, since the small nozzles 2*c* are arranged at pitch P on both sides of the ink supply port 3 in a staggered manner, two lines of small dots 13 are printed within the range of two pitches in the first pass as shown in (c)-1 of FIG. 6C. Since only the small dots 13 are used in current print mode, the effects of crosstalk can be reduced. This allows printing at a higher frequency than that in print mode in FIG. 6B. To make carriage scanning speed in all print modes in the present embodiment the same, printing in FIG. 6C is performed at a frequency of 30 kHz, which is the same as that in print mode in FIG. 6B. As shown in (c)-2 of FIG. 6C, after line feed by an odd number times the distance of pitch P, two lines of small dots 13 are printed in the second pass. As shown in (c)-3 of FIG. 6C, printing in the third pass starts after line feed by a quarter of pitch P and displacement by a quarter of pitch P in the scanning direction. Then as shown in (c)-4 of FIG. 6C, after line feed by an odd number times the distance of pitch P, printing starts at a point displaced by a quarter of pitch P in the scanning direction, and two lines of small dots 13 are printed in the fourth pass, in the same manner as that in (c)-3 of FIG. 6C. Thus, a print resolution of 2400 dpi×2400 dpi can be achieved. In the present embodiment, the positions of the print dots in (c)-3 and (c)-4 of FIG. 6C are displaced from those in (c)-1 and (c)-2 of FIG. 6C. However, even if the print dots in (c)-1 and (c)-2 of FIG. 6C overlap with those in (c)-3 and (c)-4 of FIG. 6C, excellent print quality can be achieved, as the sizes of the actual dots are larger than the sizes of the dots shown in FIGS. 6A to 6C. In the present embodiment, desired printing can be completed (100%) in four passes, and high-quality photo printing can be achieved. Since 32 small dots 13 are placed in a two-pitch square pixel, the total volume of ejected ink is 32×1.5 pl=48 pl, which is the same as those in printing in FIGS. 6A and 6B.

As described above, in the present embodiment, the inkjet head with groups of nozzles for ejecting large, medium, and small volumes of ink can accommodate high-speed and high-quality printing because of the large number of small nozzles for producing small dots. The inkjet head can also accommodate high-speed photo printing (two passes) with medium and small dots, and one-pass printing and high-speed printing (two passes) with large dots.

The volumes of ink to be ejected and print modes are not limited to those specified in the examples described above. FIG. 5B shows a modification of the third embodiment according to the present invention. This modification differs from the nozzle configuration in FIG. 5A in that the large nozzles 2*a* and the small nozzles 2*c* are staggered on the left side of the ink supply port 3, and that the medium nozzles 2*b* and the small nozzles 2*c* are staggered on the right side of the ink supply port 3. In this modification, the large nozzles 2*a* and the medium nozzles 2*b* are arranged near the ink supply port 3. Since this reduces refill time for the large nozzles 2*a* and the medium nozzles 2*b*, printing in print mode shown in FIG. 6B can be performed at higher frequencies, and thus photo printing can be performed at higher speed. While the large nozzles 2*a* and the medium nozzles 2*b* are arranged near the ink supply port 3 in this modification, the small nozzles 2*c* may be arranged close to the ink supply port 3, instead, to further increase the speed of high-quality photo printing in print mode shown in FIG. 6C.

Fourth Embodiment

Figure 7:
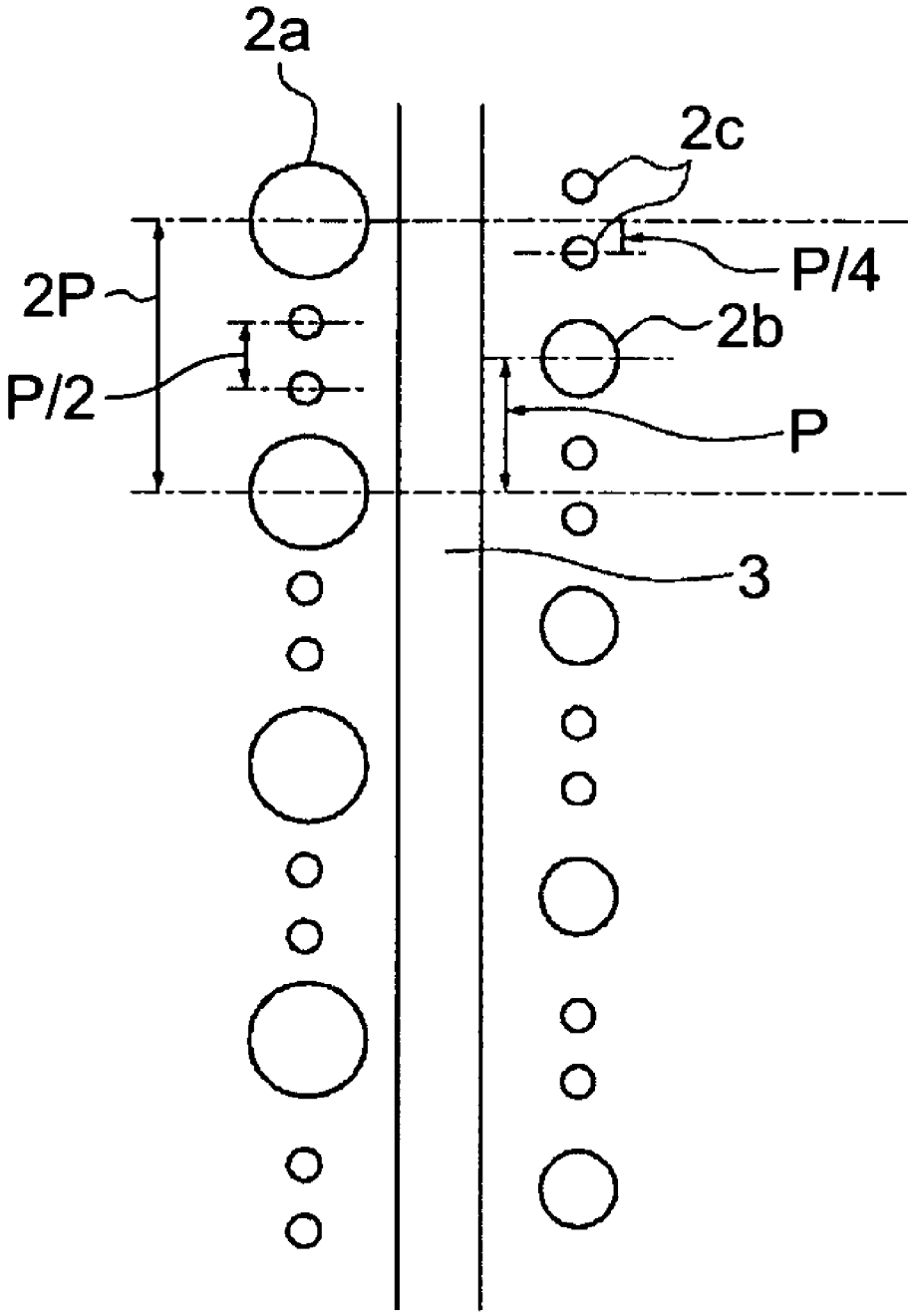
FIG. 7 is a diagram for explaining a nozzle configuration according to a fourth embodiment of the present invention.

FIG. 7 shows the fourth embodiment of the present invention. Referring to FIG. 7, large nozzles 2*a* (with pitch 2P) for 300 dpi resolution and small nozzles 2*c* (with pitch P/2) for 1200 dpi resolution are arranged in a line on the left side of an ink supply port 3. Medium nozzles 2*b* (with pitch 2P) for 300 dpi resolution and the small nozzles 2*c* (with pitch P/2) for 1200 dpi resolution are arranged on the right side of the ink supply port 3. As shown in FIG. 7, a center line of a medium nozzle 2*b* is displaced by the distance of pitch P from a center line of a large nozzle 2*a*, while a center line of a small nozzle 2*c* is displaced by the distance of pitch P/4 from a center line of a large nozzle 2*a*.

The volume of droplets ejected from each of the large, medium, and small nozzles varies, for example, depending on the nozzle pitch P or the physical properties of the ink. In the present embodiment, where the nozzle pitch P corresponds to a resolution of 600 dpi, the volumes of ink ejected from a large nozzle 2*a*, medium nozzle 2*b*, and small nozzle 2*c* are 12 pl, 4.5 pl, and 1.5 pl, respectively.

Figure 8A:
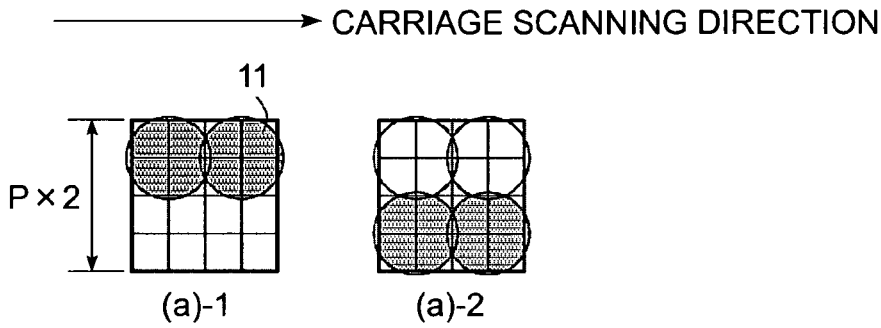
FIGS. 8A to 8C are diagrams for explaining print conditions in each print mode of a liquid ejection recording head according to the fourth embodiment of the present invention.
Figure 8B:
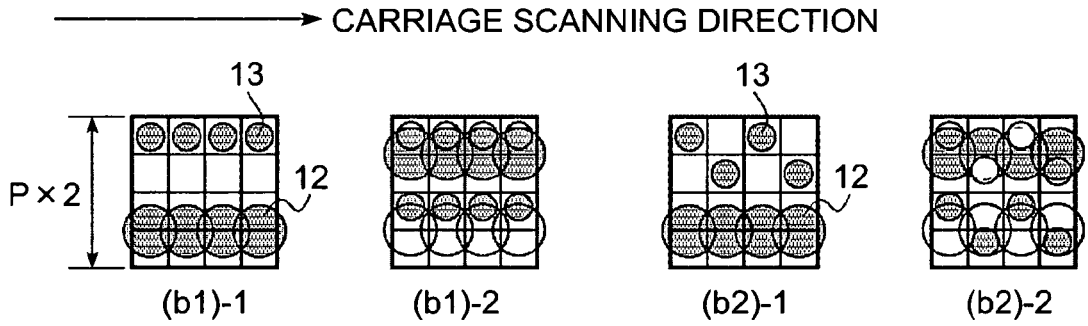
Figure 8C:
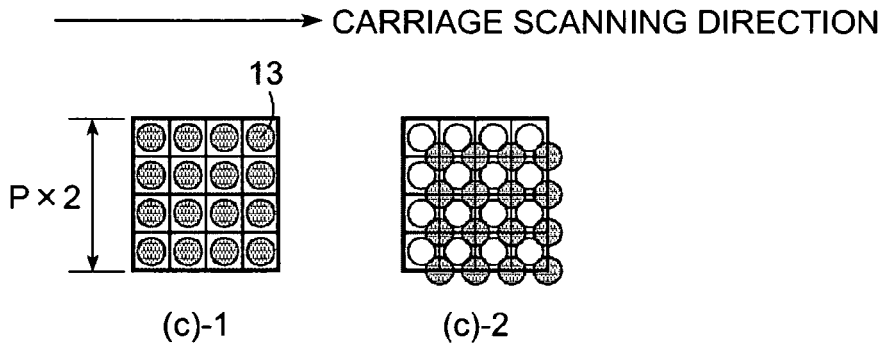

FIGS. 8A to 8C illustrate print conditions in each print mode of a recording head according to the present embodiment. FIG. 8A shows print patterns for high-speed printing, such as color printing on plain paper, FIG. 8B shows print patterns for high speed photo printing, and FIG. 8C shows print patterns for high-quality photo printing. In FIGS. 8A to 8C, numbers suffixed to (a), (b), and (c) indicate the counts of passes in multipass printing. Shaded circles (print dots) show dots printed in the current pass, and open circles (print dots) show dots printed in previous passes. For clearly presenting the print patterns, FIGS. 8A to 8C only show dots printed in a two-pitch square (300 dpi square) area, and the sizes of the dots are smaller than their actual sizes. The print patterns in each mode will now be described in detail.

In FIG. 8A, (a)-1 shows print patterns for high-speed printing, such as color printing on plain paper, where only large dots 11 from the large nozzles 2*a* are printed. Since the large nozzles 2*a* are arranged at pitch 2P, one dot can be placed within the range of two pitches as shown in (a)-1. The next dot is printed at a point displaced by the distance of pitch P, in the scanning direction, from the current position. Thus, desired printing can be completed (100%) in two passes. Since four large dots 11 are placed in a two-pitch square pixel, the total volume of ejected ink is 4×12 pl=48 pl.

In FIG. 8B, (b1)-1 and (b1)-2 show print patterns for high-speed photo printing, where medium dots 12 from the medium nozzles 2*b* and small dots 13 from the small nozzles 2*c* are printed. Since the nozzles are arranged as shown in FIG. 7, a medium dots 12 and a small dots 13 are simultaneously printed within the range of two pitches in the first pass as shown in (b1)-1 of FIG. 8B. The next dots are placed at a position displaced by half the distance of pitch P, in the scanning direction, from the current position. Thus, a print resolution of 600 dpi×1200 dpi can be achieved. The ejection frequency of print dots is largely dependent on the size of print dots (volume of ejected ink). The smaller the size of dots, the shorter the time required for ink recovery (hereinafter referred to as refill time), and thus smaller dots allows printing at high frequencies. Since the large nozzles 2*a* for ejecting the large dots 11 are not used in FIG. 8B, the frequency at which printing is performed is higher than that in the case where the large nozzles 2*a* are used as in FIG. 8A. While the drive frequency in print mode in FIG. 8A is 15 kHz, the drive frequency in current print mode in FIG. 8B is 30 kHz, which is double that in FIG. 8A. Therefore, printing in current print mode can be performed at the same carriage scanning speed as that in FIG. 8A. As shown in (b1)-2 of FIG. 8B, after line feed by an odd number times the distance of pitch P, the small dots 13 and the medium dots 12 are placed over the medium dots 12 and the small dots 13, respectively, in the second pass. High-speed photo printing can thus be achieved in the present embodiment, as desired printing can be completed (100%) in two passes without sacrificing the speed of carriage scanning. Since eight medium dots 12 and eight small dots 13 are placed in a two-pitch square pixel, the total volume of ejected ink is 8×(4.5+1.5) pl=48 pl, which is the same as that in printing in FIG. 8A.

In the present embodiment, the medium dots 12 may be placed as in (b2)-1 and (b2)-2 of FIG. 8B. Since, in this print mode, the small dots 13 can be produced by different nozzles, the medium dots 12 with less unevenness can be made compared to those in (b1)-1 and (b1)-2 of FIG. 8B.

FIG. 8C shows print patterns for high-quality photo printing, where only the small dots 13 from the small nozzles 2*c* are printed. As shown in FIG. 7, since sets of two small nozzles 2*c* with an interval of pitch P/2 are arranged on both sides of the ink supply port 3 in a staggered manner, two lines of small dots 13 are printed within the range of two pitches in the first pass as shown in (c)-1 of FIG. 8C. Since only the small dots 13 are used in current print mode, printing can be performed at a higher frequency than that in print mode in FIG. 8B. To make carriage scanning speed in all print modes in the present embodiment the same, printing in FIG. 8C is performed at a frequency of 30 kHz, which is the same as that in print mode in FIG. 8B. As shown in (c)-2 of FIG. 8C, printing starts after line feed by a quarter of pitch P. Thus, a print resolution of 2400 dpi×2400 dpi can be achieved. In the present embodiment, the positions of the print dots in (c)-2 of FIG. 8C are displaced from those in (c)-1 of FIG. 8C. However, even if the print dots in (c)-2 of FIG. 8C overlap with those in (c)-1 of FIG. 8C, excellent print quality can be achieved, as the sizes of the actual dots are larger than the sizes of the dots shown in FIGS. 8A to 8C. In the present embodiment, desired printing can be completed (100%) in two passes, and high-quality photo printing can be achieved. Since 32 small dots 13 are placed in a two-pitch square pixel, the total volume of ejected ink is 32×1.5 pl=48 pl, which is the same as those in printing in FIGS. 8A and 8B.

As described above, in the present embodiment, the inkjet head with groups of nozzles for ejecting large, medium, and small volumes of ink can accommodate high-speed and high-quality printing because of the large number of small nozzles for producing small dots. The inkjet head can also accommodate high-speed photo printing (two passes) with medium and small dots, and one-pass printing and high-speed printing (two passes) with large dots.

High-quality printing can thus be achieved according to the present embodiment, since the number of the small nozzles 2*c* for ejecting a small volume of ink is larger than that of the large nozzles 2*a* for ejecting a large volume of ink, and that of the medium nozzles 2*b* for ejecting a medium volume of ink. Moreover, since medium dots are printed with the medium nozzles 2*b*, images with uniform density and no stripes and unevenness can be obtained. Furthermore, since the small nozzles 2*c* are arranged in a staggered manner on both sides of the ink supply port 3, the inkjet recording head is less likely to be affected by crosstalk, and capable of performing high-quality printing only with small dots at a higher speed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-259630 filed Sep. 7, 2004, which is hereby incorporated by reference herein in its entirety.

What is claimed is:

1. A liquid ejection recording head comprising:

a plurality of nozzles through which liquid supplied from a liquid supply port is ejected to a recording medium, the plurality of nozzles being provided on both sides of the liquid supply port, wherein the plurality of nozzles includes first nozzles each having a first diameter, second nozzles each having a second diameter, and third nozzles each having a third diameter, wherein the first diameter is larger than the second diameter, and the third diameter is smaller than the second diameter, and wherein a number of third nozzles is greater than a number of first nozzles, and is greater than a number of second nozzles.

2. The liquid ejection recording head according to claim 1, wherein the third nozzles are provided only on one side of the liquid supply port, and the first nozzles and the second nozzles are provided on the other side of the liquid supply port.

3. The liquid ejection recording head according to claim 2, wherein the first nozzles and the second nozzles are alternately arranged at a density equal to that of the third nozzles.

4. The liquid ejection recording head according to claim 2, wherein the first nozzles and the second nozzles are alternately arranged at a density lower than that of the third nozzles.

5. The liquid ejection recording head according to claim 1, wherein the first nozzles and the third nozzles are provided on one side of the liquid supply port, and the second nozzles and the third nozzles are provided on the other side of the liquid supply port.

6. The liquid ejection recording head according to claim 1, wherein a distance from each of the third nozzles to the liquid supply port is shorter than a distance from any one of each of the first nozzles and each of the second nozzles to the liquid supply port.

7. The liquid ejection recording head according to claim 1, further comprising:

channels corresponding to the first, second and third nozzle; and filters provided at an end of each channel corresponding to the first, second and third nozzles, the end being close to the liquid supply port, wherein the filters each has a size corresponding to the size of the respective nozzles.

* * * * *